US011703301B2

(12) United States Patent
Dudley et al.

(10) Patent No.: US 11,703,301 B2
(45) Date of Patent: Jul. 18, 2023

(54) ARCHERY RELEASE

(71) Applicant: Carter Enterprises, St. Anthony, ID (US)

(72) Inventors: Johnathan Dudley, Indianola, IA (US); Jerry Carter, St. Anthony, ID (US)

(73) Assignee: Carter Enterprises, St. Anthony, ID (US)

( * ) Notice: Subject to any disclaimer, the term of this patent is extended or adjusted under 35 U.S.C. 154(b) by 45 days.

(21) Appl. No.: 17/130,746

(22) Filed: Dec. 22, 2020

(65) Prior Publication Data

US 2022/0196362 A1 Jun. 23, 2022

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
USPC ..... 124/35.2
See application file for complete search history.

(56) References Cited

U.S. PATENT DOCUMENTS 3,898,974 A * 8/1975 Keck ..... F41B 5/1469 124/35.2
3,952,720 A * 4/1976 Wilson ..... F41B 5/1469 124/35.2
4,672,945 A * 6/1987 Carlton ..... F41B 5/1469 124/35.2
4,691,683 A * 9/1987 Peck ..... F41B 5/1469 124/35.2
4,881,516 A * 11/1989 Peck ..... F41B 5/1469 124/35.2
5,025,772 A * 6/1991 Stevenson ..... F41B 5/1469 124/35.2
5,067,472 A * 11/1991 Vogel ..... F41B 5/1469 124/40
5,070,854 A * 12/1991 Peck ..... F41B 5/1469 124/31
5,103,796 A * 4/1992 Peck ..... F41B 5/1469 124/35.2
5,224,463 A * 7/1993 Townsend ..... F41B 5/1469 124/31
5,247,922 A * 9/1993 Lalonde ..... F41B 5/14 124/90
5,307,788 A * 5/1994 Peck ..... F41B 5/1469 124/35.2
5,318,004 A * 6/1994 Peck ..... F41B 5/1469 124/35.2
5,370,102 A * 12/1994 Peck ..... F41B 5/1469 124/35.2
5,494,023 A * 2/1996 Kolak ..... F41B 5/1469 124/32

(Continued)

*Primary Examiner* — Alexander R Niconovich
(74) *Attorney, Agent, or Firm* — Merchant & Gould P.C.

(57) ABSTRACT

An archery release that includes, in one embodiment, a tension activated wrist strap index finger trigger release is provided. The trigger release includes a housing, a tension release assembly, and a trigger assembly. The tension release assembly is configured to alternate between a first state when the pulling force is below a predetermined threshold and a second state when the pulling force is above a predetermined threshold. The trigger assembly is configured to selectively activate the tension release assembly.

21 Claims, 11 Drawing Sheets

(56) References Cited

U.S. PATENT DOCUMENTS 5,575,269 A * 11/1996 Harklau ..... F41B 5/1469 124/32
5,765,536 A * 6/1998 Scott ..... F41B 5/1469 124/35.2
5,845,628 A * 12/1998 Pellerite ..... F41B 5/1469 124/35.2
6,032,661 A * 3/2000 Goff ..... F41B 5/1469 124/35.2
6,247,467 B1 * 6/2001 Siegfried ..... F41B 5/1469 124/35.2
6,478,020 B1 * 11/2002 Rentz ..... F41B 5/1469 124/35.2
6,481,430 B1 * 11/2002 Lightcap, Jr. ..... F41B 5/1469 124/35.2
6,484,710 B1 * 11/2002 Summers ..... F41B 5/1469 124/35.2
6,736,124 B2 * 5/2004 Carter ..... F41B 5/1469 124/35.2
6,763,819 B2 * 7/2004 Eckert ..... F41B 5/1469 124/35.2
6,925,995 B1 * 8/2005 McConnell ..... F41B 5/1469 124/35.2
6,945,241 B2 * 9/2005 Pellerite ..... F41G 1/35 124/35.2
7,188,616 B1 * 3/2007 McConnell ..... F41B 5/1469 124/35.2
7,240,672 B2 * 7/2007 Peck ..... F41B 5/1469 124/35.2
7,314,045 B2 * 1/2008 Eckert ..... F41B 5/1469 124/35.2
7,581,536 B2 * 9/2009 Porter ..... F41B 5/1469 124/35.2
7,926,475 B2 * 4/2011 Jones ..... F41B 5/1469 124/35.2
8,402,957 B1 * 3/2013 Clark ..... F41B 5/1469 124/35.2
8,869,781 B2 * 10/2014 Jones ..... F41B 5/1469 124/90
8,997,729 B1 * 4/2015 Gillig ..... F41B 5/1469 124/35.2
9,027,540 B2 * 5/2015 Springer ..... F41B 5/1469 124/90
9,638,489 B1 * 5/2017 Long ..... F41B 5/1469
9,915,491 B2 * 3/2018 Perry ..... F41A 19/10
10,801,803 B1 * 10/2020 Rentz ..... F41B 5/1469
10,845,154 B2 * 11/2020 Griggs ..... F41B 5/1469
11,243,043 B1 * 2/2022 Rentz ..... F41B 5/1469
2006/0042612 A1 * 3/2006 Stanislawski ..... F41B 5/1469 124/35.2
2016/0025445 A1 * 1/2016 Kelly ..... F41B 5/1469 124/35.2

* cited by examiner

ARCHERY RELEASE

TECHNICAL FIELD

Mechanical archery releases.

BACKGROUND

Traditionally, an archer knocks an arrow onto a bow string and uses his or her fingers to pull/draw back the bow string while holding the bow steady with the archer's opposite hand. To fire the arrow, the archer manually releases the bow string. This traditional style of archery is challenging as the bow string digs into the shooter's fingers and it is difficult to release the arrow without adversely affecting the desired trajectory of the arrow.

Mechanical archery releases have been developed to aid the shooter in holding the bow string and releasing the bow string in a smooth manner. Mechanical archery releases have greatly improved archers' accuracy and has also made shooting arrows more ergonomic. Many modern compound bows are extremely compact and are designed to be used with mechanical archery releases. Manually pulling/drawing the modern compound bows with one's fingers would be highly irregular and result in accuracy issues.

Most mechanical archery releases can be categorized into two general types: (1) wrist strap index finger trigger releases and (2) handheld "tension" releases. Wrist strap index finger trigger releases typically include wrist straps that aid in the drawing of the bow string and a trigger that when pulled causes the bow to fire. Wrist strap index finger trigger releases typically include a small housing that connects the wrist strap to the bow string and includes an outwardly extending trigger member that is used by the shooter to fire the arrow. Wrist strap releases are commonly used and function relatively well. However, for some shooters these types of releases are problematic. The use of wrist strap trigger releases often results in "shot anticipation" since the archer can learn over time the exact moment that the shot will fire based on the tension and travel of the trigger. Once the shooter learns the release, the shooter may develop an involuntary flinch just before and during the firing of the shot. This flinch can result in extreme inaccuracy.

"Tension" releases are also commonly used. These types of releases include a hand or finger grip that the user pulls on to draw the bow. Some are fired by activating a thumb trigger/safety, others are fired by slightly twisting the release (often called "hinge style releases" and are not actually tension activated), and others are fired by increasing the pulling force on the device (true tension activated releases). These types of releases are designed to make it less likely that the shooter will anticipate the firing of the bow and hence develop an undesirable involuntary flinching or target panic. However, some shooters disfavor these types of releases for hunting applications as they perceive that the release provides the archer less control over the exact moment the arrow is fired as compared to index finger trigger releases. Firing an arrow quickly and with control with such "tension" based devices typically requires many hours of practice.

There is a need in the art for improved archery releases that include the advantages of the various styles of existing releases while also avoiding the drawbacks commonly associated with existing releases.

SUMMARY

The present disclosure provides an archery release that embodies many of the desirable features of prior art archery releases while avoiding many of the disadvantages of prior art archery releases. In one embodiment, a novel tension activated wrist strap index finger trigger release is provided.

In one embodiment, the archery release of the present disclosure can be used with a wrist strap. This wrist strap compatibility allows the shooter to efficiently draw the bow and hold the bow at full draw. The drawing force is transferred to the wrist rather than through the shooter's fingers and hand. The shooter can open and relax his or her hand while in the full draw position which can enable the shooter to relax, shoot longer sessions, and hold longer on target when needed.

In one embodiment, the archery release of the present disclosure can be set up to be trigger activated. This functionality is desirable as trigger active shooting is intuitive and can be preferred in a certain hunting context. For example, the trigger activated shot can be desirable when it is desirable to take a shot quickly as when an animal is moving swiftly through a narrow shooting lane.

In one embodiment, the archery release of the present disclosure can be set up to be tension activated. This functionality is desirable as it trains the shooter to use proper shooting form and to shoot more dynamically. The release of the present disclosure encourages the archer to pull through the shot, which is the technique used by top archers to get the best performance out of modern compound bows. The tension activated functionality of the release of the present disclosure can be very useful when shooting targets or when shooting in hunting situations that require a great deal of accuracy such as longer range shots.

In one embodiment, the archery release of the present disclosure includes a normally on safety mechanism. The release of the present disclosure minimizes misfires as the archer does not need to remember to activate a manual safety prior to drawing the bow to prevent a misfire. The release of an embodiment of the present disclosure has a safety that is configured to be normally on. To cause the bow to fire, the archer must take deliberate action by at least pulling the trigger. In some shooting modes, the shooter must depress the trigger and also apply additional tension by pulling through to fire the arrow.

In one embodiment, the archery release of the present disclosure allows the shooter to easily and reliably back off the shot. The shooter can prepare to take the shot and at the very last moment decide against taking the shot. The shooter can simply let off the trigger and the system automatically re-engages the safety so that even if additional tension is applied by the archer, the bow will not misfire.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
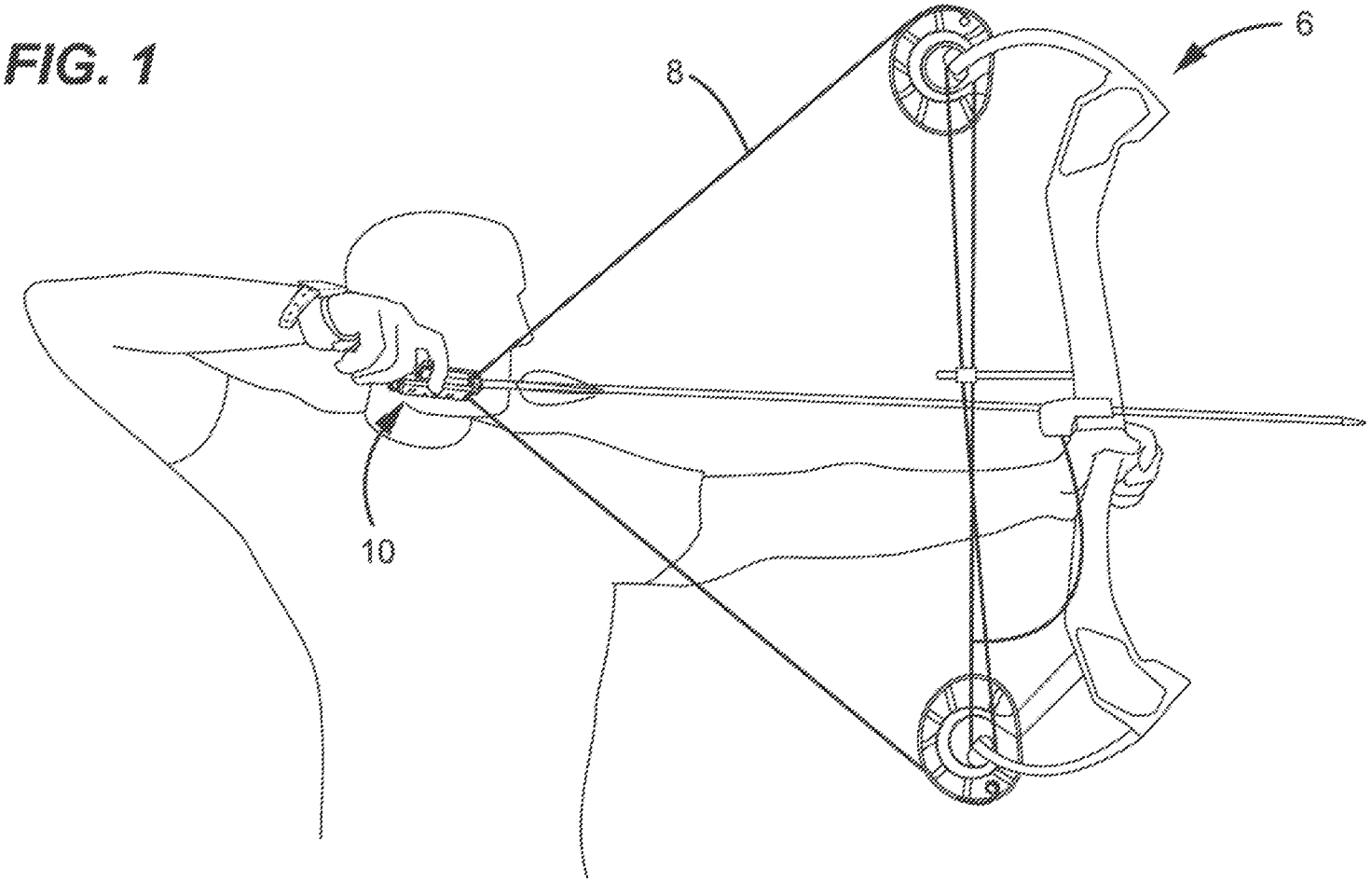
FIG. 1 is an illustration of a shooter using an archery release of the present disclosure to draw a bow.

Referring to the figures, an embodiment of an archery release 10 according to the principles of the present disclosure is described herein in further detail. In the depicted embodiment, the archery release 10 is a device that aids the archer (also referred to herein as the shooter) in drawing the bow string 8 (pulling back the bow string 8), holding the bow 6 at full draw (FIG. 1), and releasing the bow string 8 without deflecting the arrow from its intended trajectory.

Figure 2:
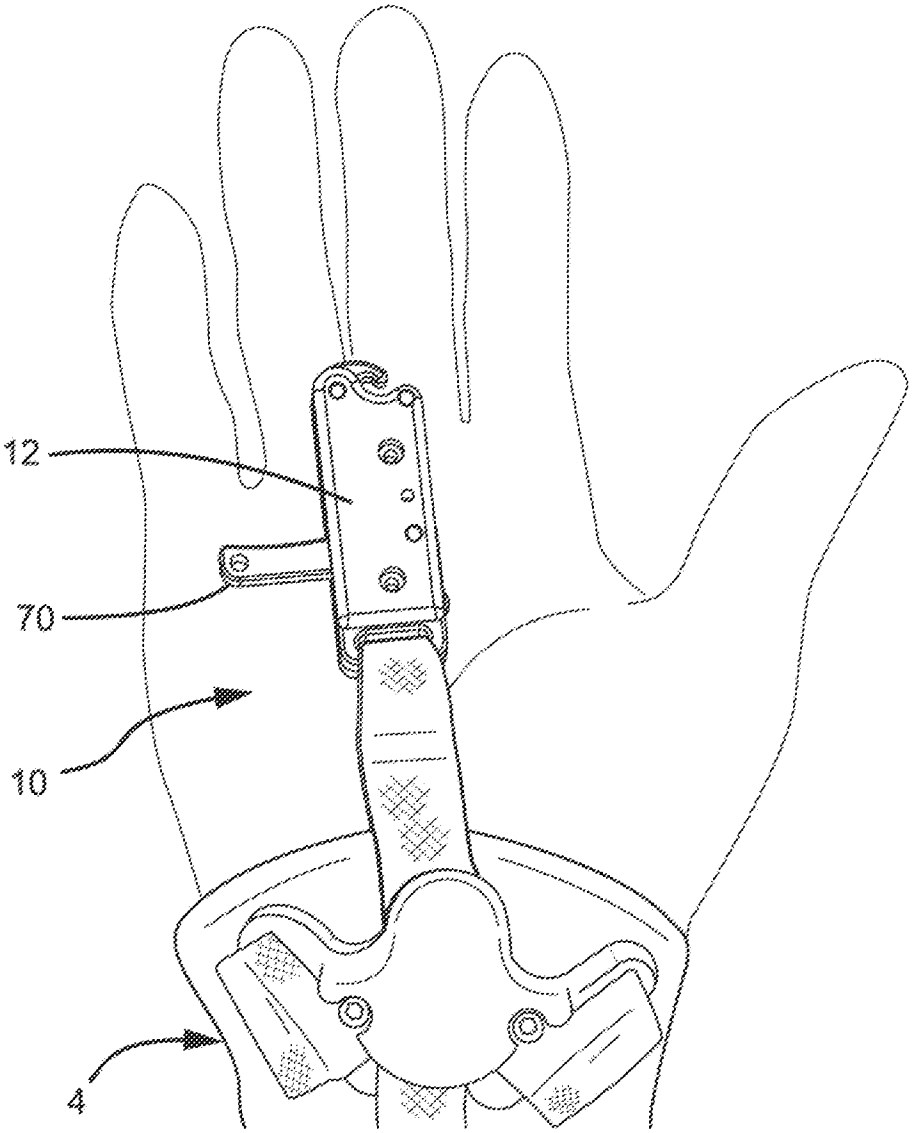
FIG. 2 is an illustration of the archery release of FIG. 1 connected to a shooter's wrist.
Figure 3:
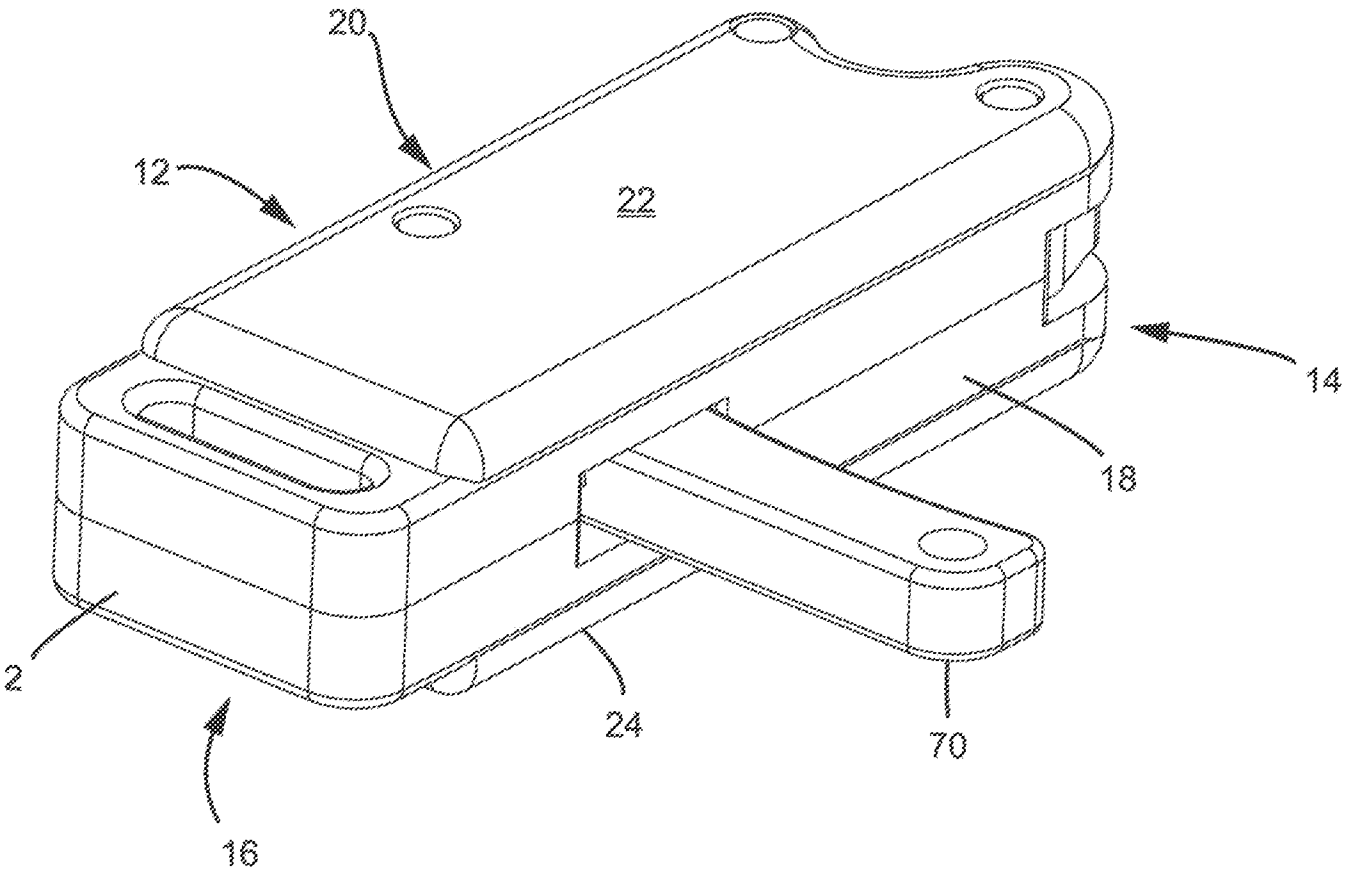
FIG. 3 is an isometric rear top view of the archery release of FIG. 1.
Figure 4:
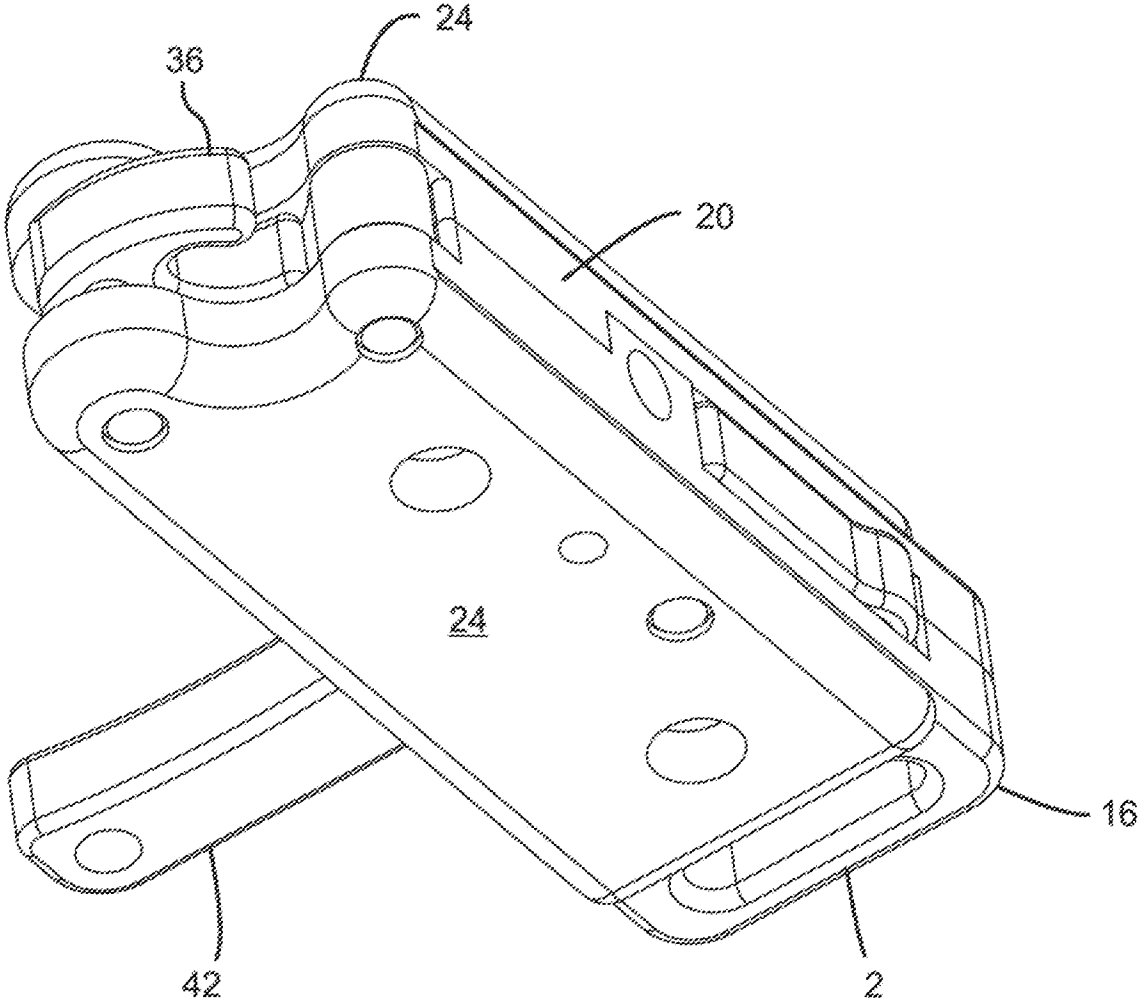
FIG. 4 is an isometric front bottom view of the archery release of FIG. 1.
Figure 5:
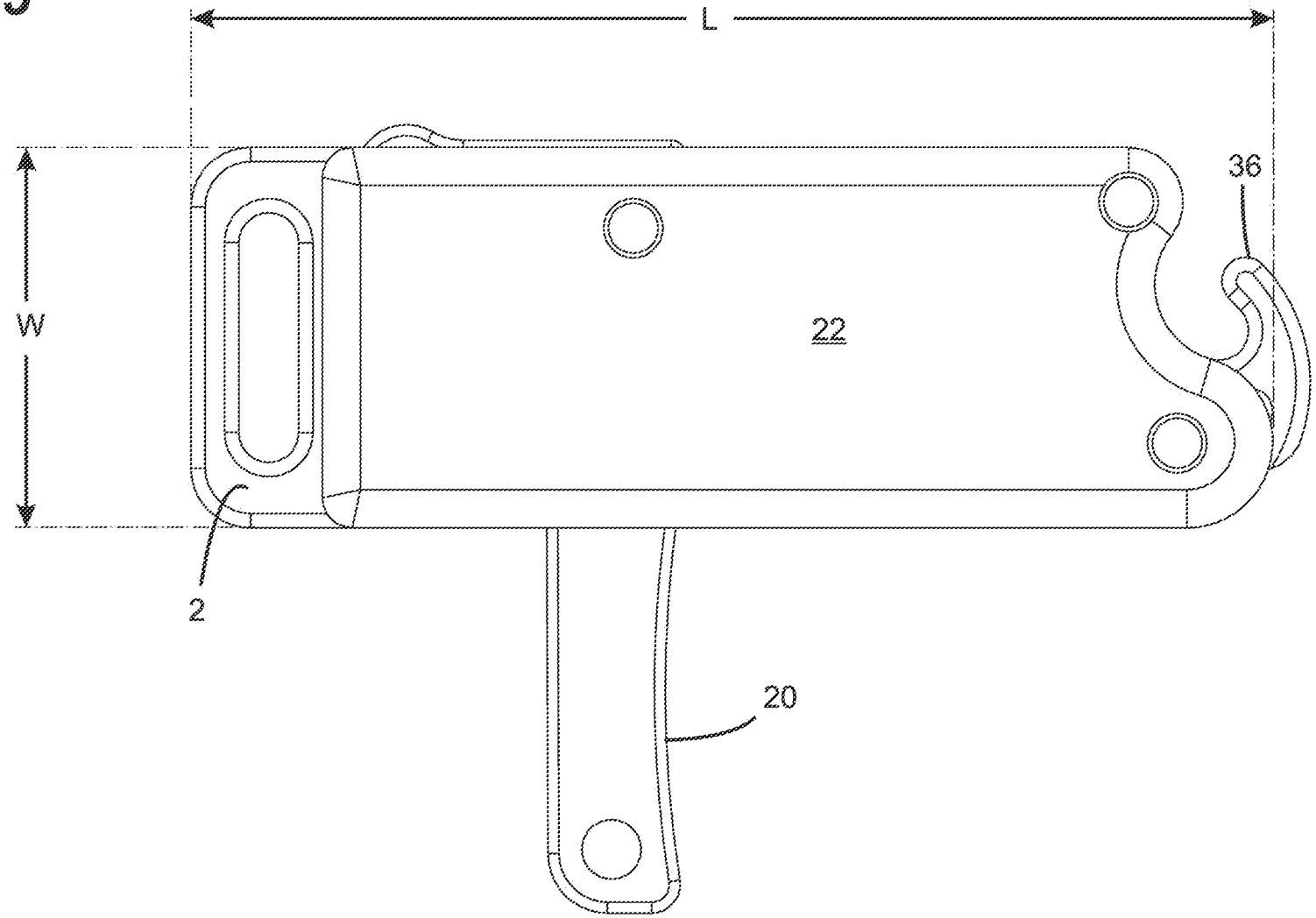
FIG. 5 is a top view of the archery release of FIG. 1.
Figure 6:
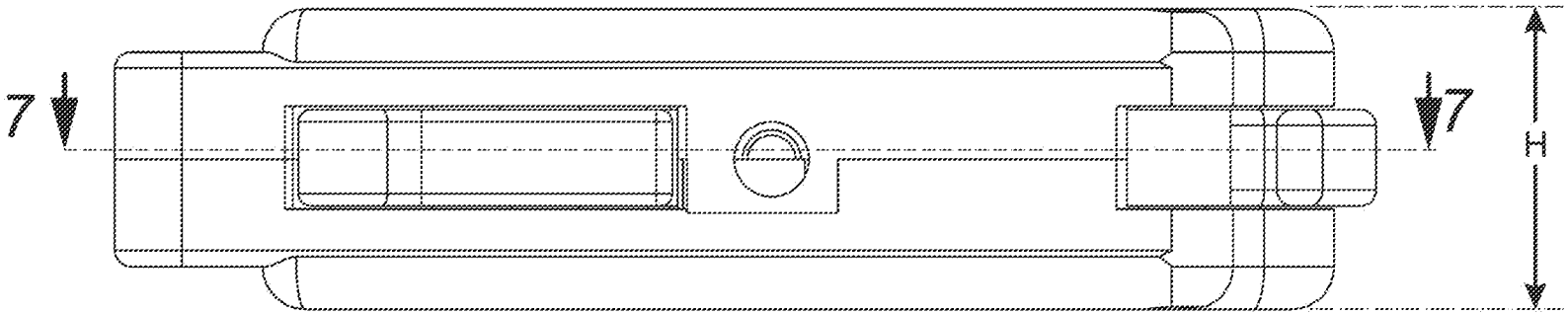
FIG. 6 is a first side view of the archery release of FIG. 1.
Figure 7:
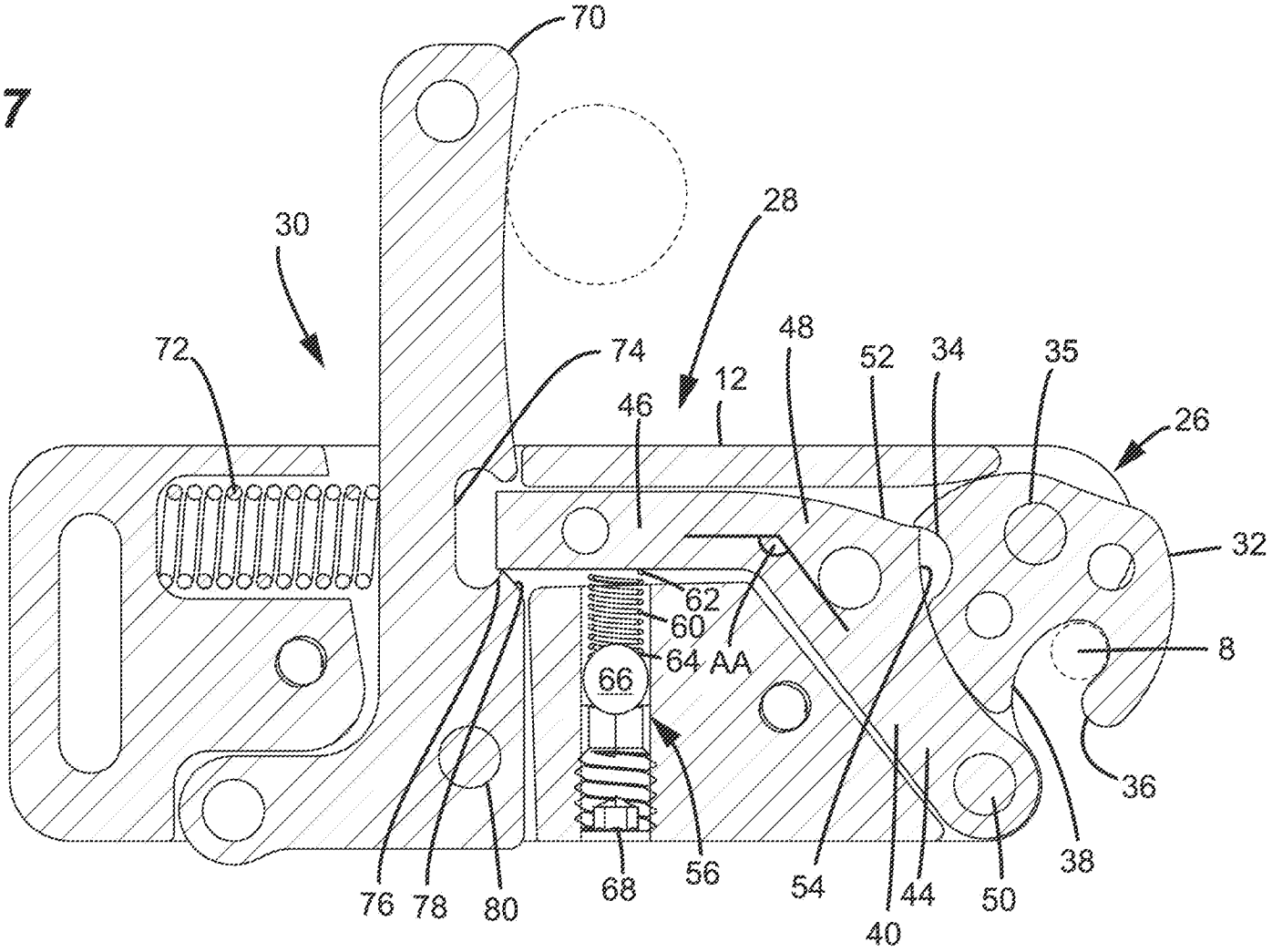
FIG. 7 is a cross-sectional view of the archery release of FIG. 1 along lines 7-7 in FIG. 6 in a first state.
Figure 8:
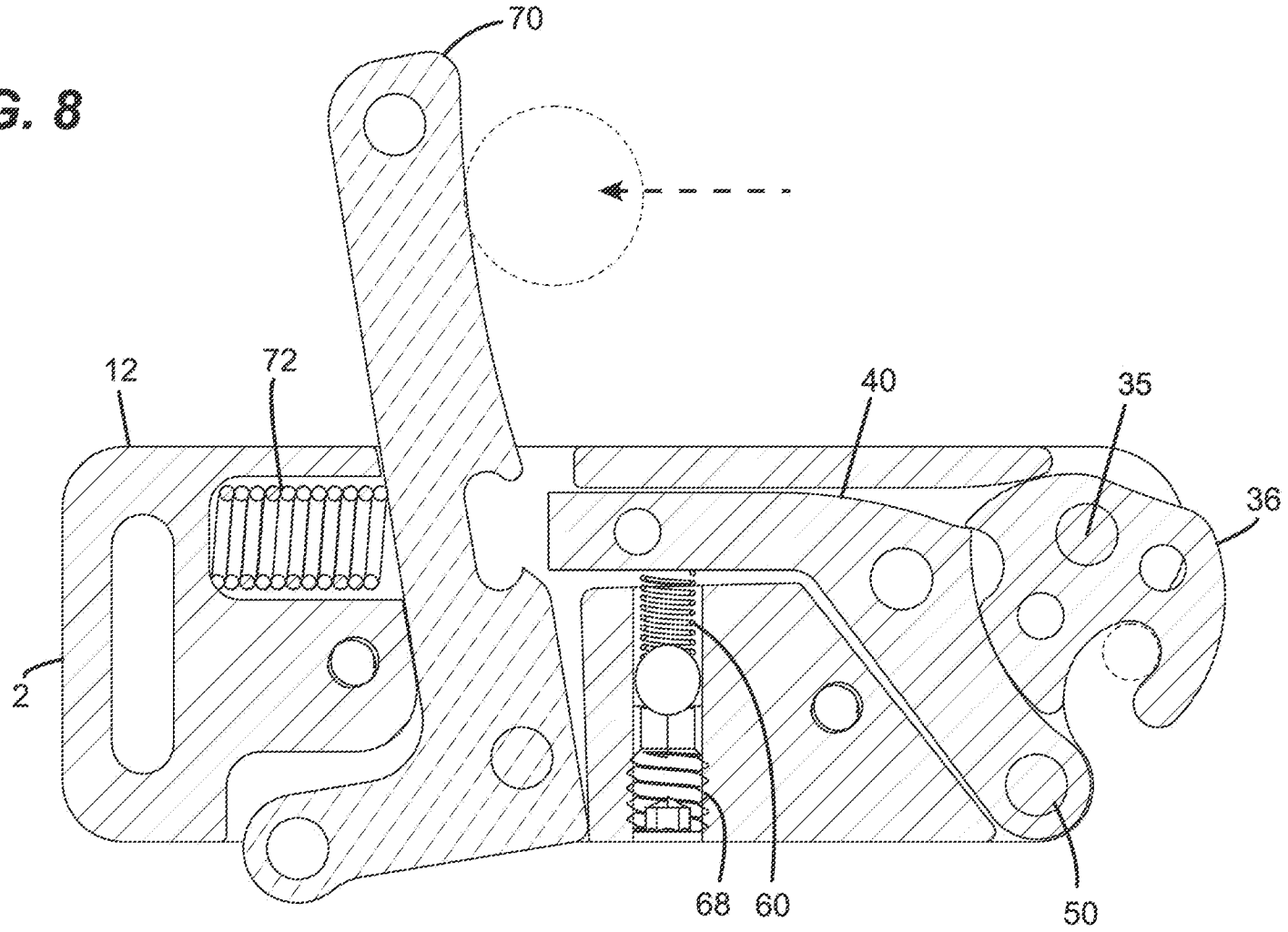
FIG. 8 is a cross-sectional view of the archery release of FIG. 1 along lines 7-7 in FIG. 6 in a second state.
Figure 9:
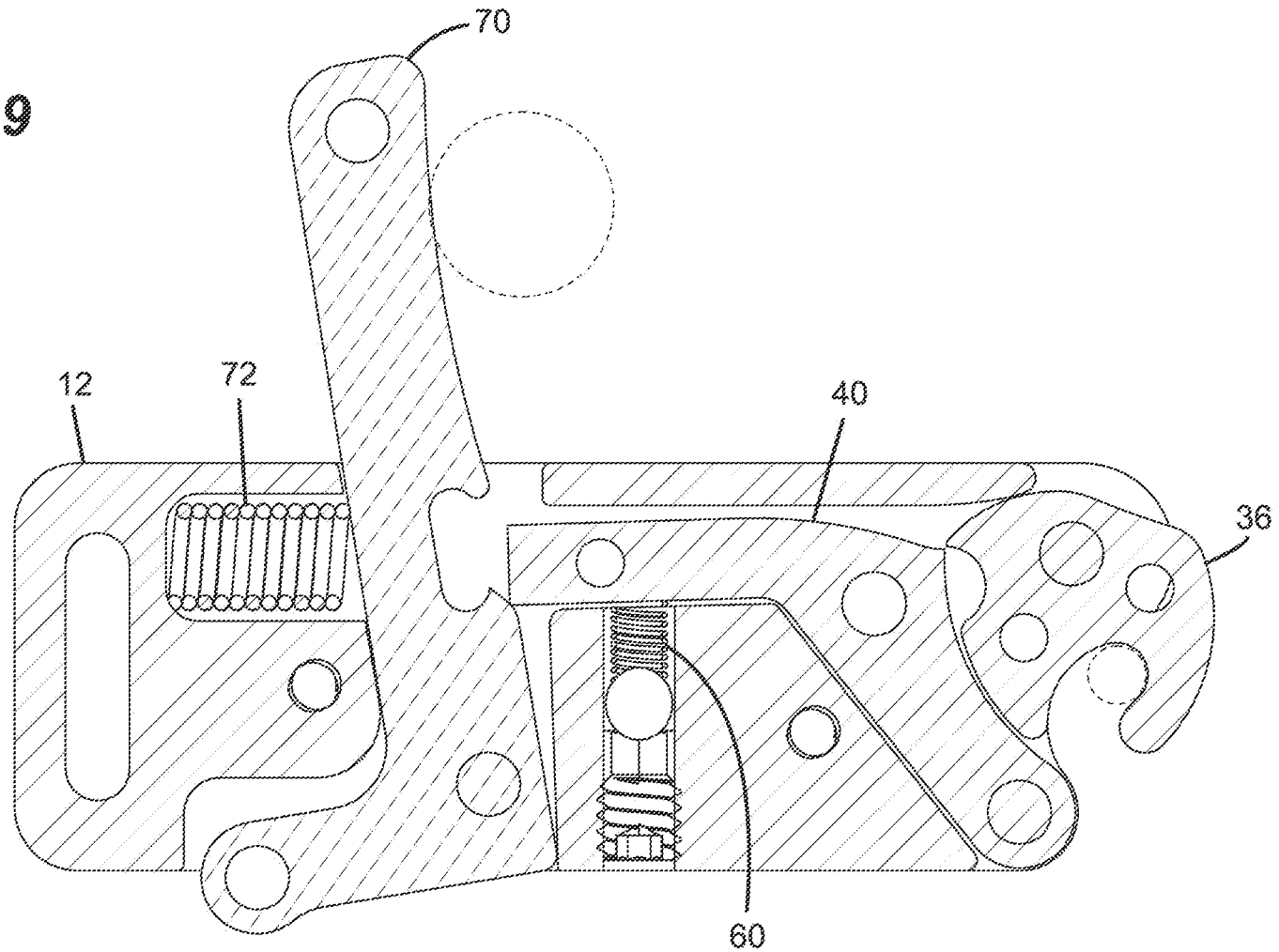
FIG. 9 is a cross-sectional view of the archery release of FIG. 1 along lines 7-7 in FIG. 6 in a third state.
Figure 10:
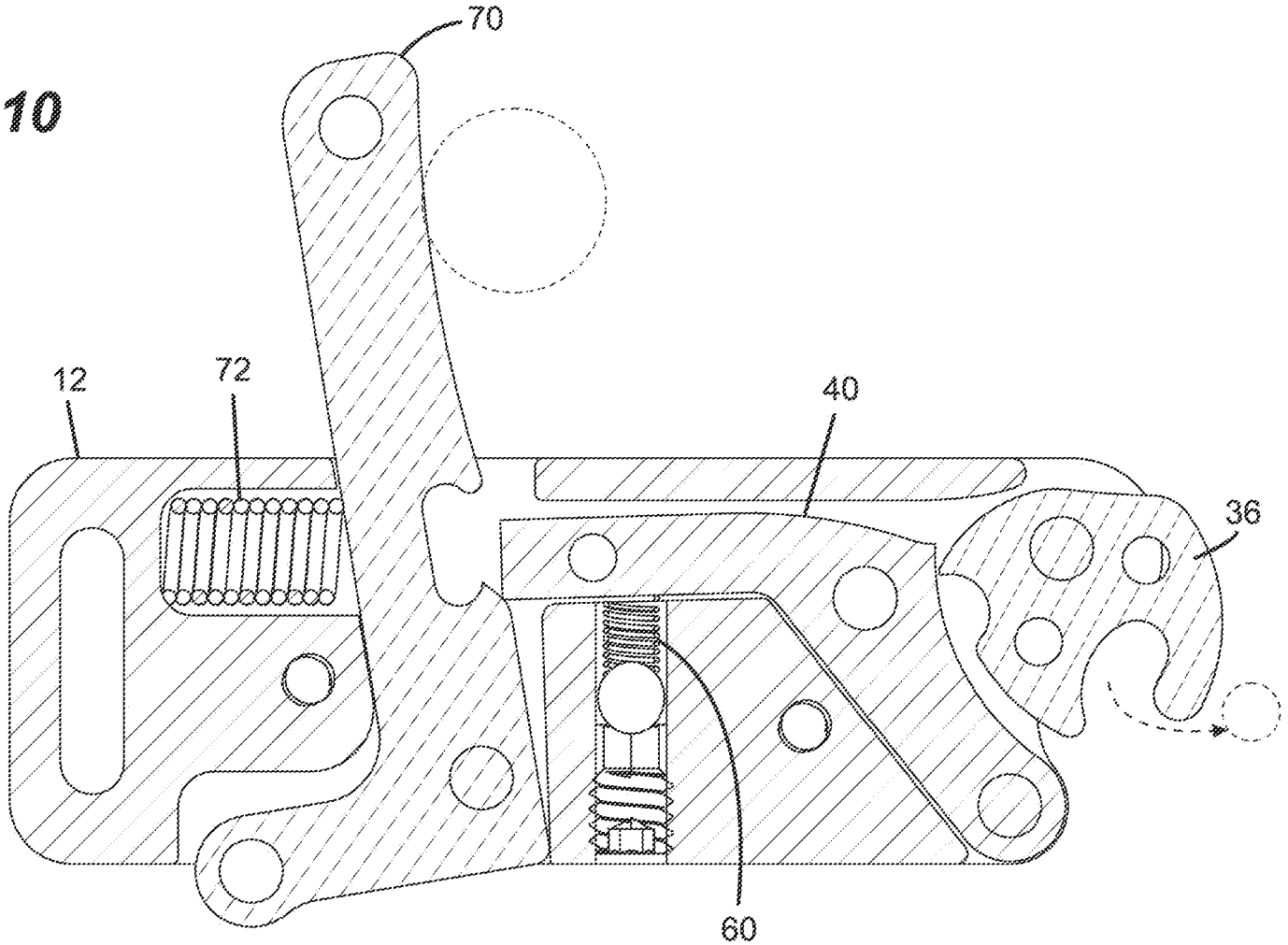
FIG. 10 is a cross-sectional view of the archery release of FIG. 1 along lines 7-7 in FIG. 6 in a fourth state.
Figure 11:
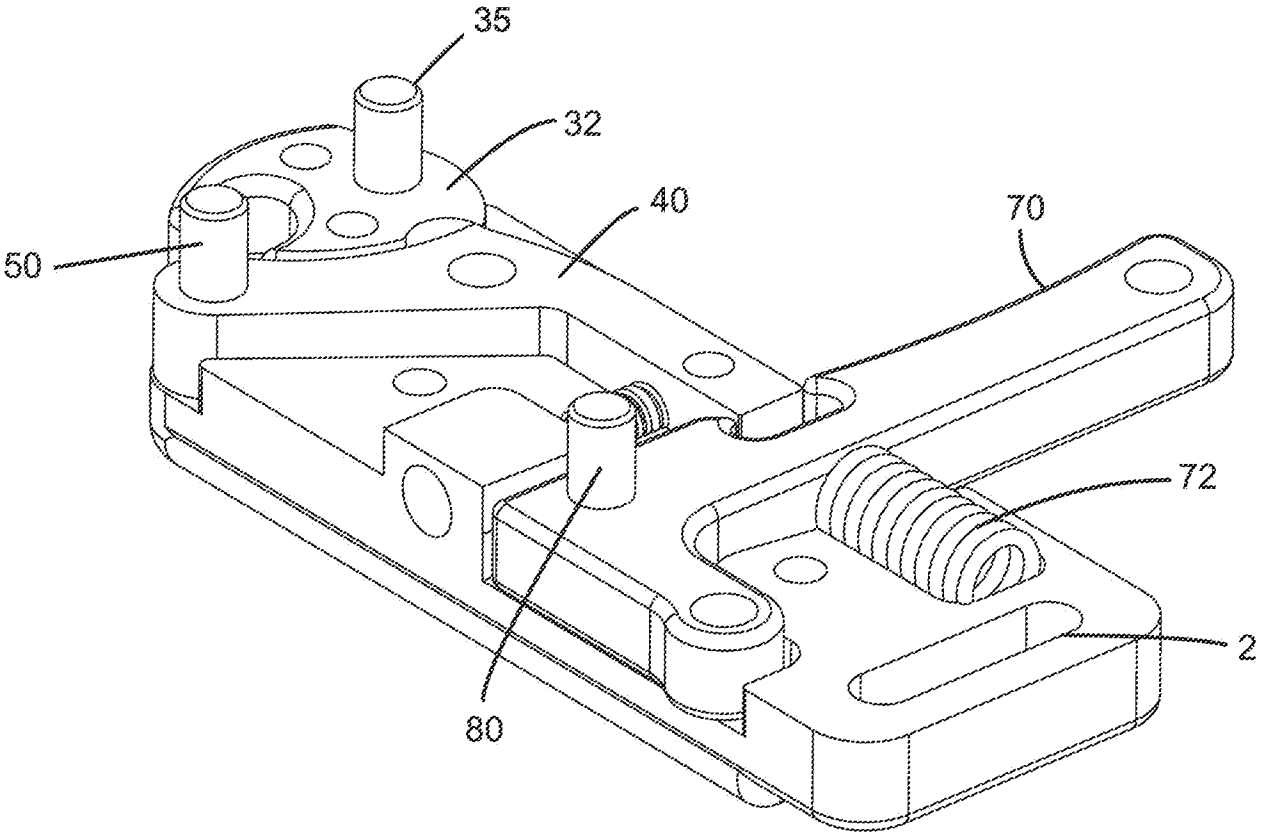
FIG. 11 is an isometric rear top view of the archery release of FIG. 1 with a portion of the housing removed.

In the depicted embodiment, the archery release 10 includes a housing 12 connected to a wrist strap 4. See FIG. 2. The wrist strap 4 is configured to be secured to the archer's wrist. In the depicted embodiment, the wrist strap 4 includes wide strap members that tighten/cinch around the archer's wrist to distribute the pulling force directly and comfortably onto the archer's bone structure (wrist). In the depicted embodiment, the archer can draw the bow 6 with his or her hand and fingers relaxed. In the depicted embodiment, the wrist strap 4 is adjustable so that it can be fit snugly onto the archer's wrist. The adjustment mechanism of the wrist strap 4 improves ergonomics and repeatability, which improves accuracy. It should be appreciated that many alternative configurations are also possible.

In the depicted embodiment, the housing 12 of the archery release 10 includes a front end portion 14, a rear end portion 16, a first side 18, a second side 20, a top portion 22, and a bottom portion 24. In the depicted embodiment, the housing 12 defines a generally narrow elongated rectangular cube shaped body. In the depicted embodiment, the length L of the housing 12 is between 40 millimeters to 80 millimeters (e.g., 45-65 millimeters); the width W of the housing 12 is between 15 millimeters to 30 millimeters (e.g., 15-25 millimeters); the height H of the housing 12 is between 10 millimeters to 20 millimeters (e.g., 12-17 millimeters). It should be appreciated that many alternative configurations are possible. For example, in an alternative embodiment, the housing 12 can have a substantially different size or shape.

In the depicted embodiment, the housing 12 includes a wrist strap anchor 2 located at the rear end portion 16 of the housing 12. In the depicted embodiment, the wrist strap 4 is connected to the anchor 2 by an adjustable tether that is adjustable in length (e.g., a cord or strap). In the depicted embodiment, the housing 12 is sized and shaped so that it fits effortlessly inside the archer's hand such that the archer can activate the release 10 with his or her index finger being the sole contact between the archery release 10 and the body of the shooter. In the depicted embodiment, in the configuration, the archer can relax his or her hand at full draw and simply pull back on his or her index finger to fire the shot or release the safety (depending on the desired mode of operation). In the depicted embodiment, the contact points between the archery release 10 and the shooter include the trigger member 70 and the wrist strap 4. Some archers may elect to rest his or her thumb pad on the second side 20 surface of the housing 12. In the depicted embodiment, the compact nature of the housing 12 and its attachment to the wrist strap 4 allows the shooter to tuck the housing 12 back into the wrist strap 4 or the shooter sleeve to prevent the housing 12 from swinging around when not engaged with a bow string 8. It should be appreciated that many other alternative housing configurations are possible.

In the depicted embodiment, the archery release 10 includes a bow string engagement assembly 26 mounted to the front end portion 14 of the housing 12. In the depicted embodiment, the bow string engagement assembly 26 is configured to engage a bow string 8 and transfer a pulling force (tension) onto the bow string 8. In the depicted embodiment, the bow string engagement assembly 26 is configured to secure the bow string 8 in a first state (closed) and release the bow string 8 in a second state (open).

In the depicted embodiment, the bow string engagement assembly 26 includes a jaw member that is configured to contact the bow string 8. In the depicted embodiment, the jaw member is configured to pivot from a closed position to an open position. In the depicted embodiment, the jaw member is a rotary disk member 32. In the depicted embodiment, the rotary disk member 32 includes an eccentric pivot 35 that pivotally connects the rotary disk member 32 to the housing 12. In the depicted embodiment, the rotary disk member is configured to pivot counterclockwise to open and clockwise to close. In the depicted embodiment, the rotary disk member 32 includes a bow string catch 36 that engages the bow string 8. In the depicted embodiment, the bow string catch 36 hooks onto a "loop" tied into the bow string 8 directly behind and in line with the knock of an arrow. In the depicted embodiment, the bow string catch 36 is in alignment with the wrist strap anchor 2, which is in line with the trajectory of the arrow as it leaves the bow 6. The depicted configuration minimizes torque in the system and improves accuracy.

In the depicted embodiment, the bow string catch 36 secures the bow string 8 to the archery release 10 until the archer deliberately decides to fire the arrow. In the depicted embodiment, the configuration of the bow string catch 36 is designed to minimize the risk of misfires. In the depicted embodiment, the rotary disk member 32 includes a sear engagement surface 34 and a sear reset foot 38. In the depicted embodiment, the sear reset foot 38 limits and controls the engagement between the sear 52 and the sear engagement surface 34. In the depicted embodiment, the sear reset foot 38 engages a surface (the accurate sliding surface 54) of the pivoting sear member and acts as a stop to limit and control the engagement of the sear 52 and the sear engagement surface 34, which results in a consistent amount of frictional force between these components that needs to be overcome for the shot to be fired. The configuration of the sear engagement surface 34 and the sear reset foot 38 facilitates a smooth and repeatable break when the arrow is fired thereby improving accuracy of the shot. It should be appreciated that many alternative configurations are possible. For example, in an alternative embodiment, the bow string engagement assembly 26 could include two opposed jaws that grab the "loop."

In the depicted embodiment, the archery release 10 includes a tension release assembly 28 provided within the housing 12. In the depicted embodiment, the tension release assembly 28 is configured to hold the bow string engagement assembly 26 in the first state (closed) where the bow string 8 is retained by the archery release 10 whenever the pulling force is below a predetermined release threshold. In the depicted embodiment, the tension release assembly 28 is configured to transition the bow string engagement assembly 26 to the second state (open) wherein the bow string 8 is released from the archery release 10 when the pulling force exceeds the predetermined release threshold. It should be appreciated that alternative configurations are also possible.

In the depicted embodiment, the predetermined release threshold of the tension release assembly 28 can be set based on the holding weight of the bow 6. The holding weight as used herein refers to the amount of tension force that is required to keep the bow 6 at a full draw. For common compound bow configurations, the holding weight is determined largely by the set draw weight and the percent of "let off" at full draw. In one embodiment, the predetermined release threshold is set several pounds higher than the holding weight of the bow 6. In this embodiment, the bow 6 will not fire immediately upon pulling the trigger if the archer maintains full draw by applying the minimum amount of tension needed to hold the bow 6 at full draw. Instead, the bow 6 will fire only after both the trigger is held down and also after the archer applies a pulling force that exceeds the predetermined release threshold which exceeds the holding weight. In this embodiment, the act of pulling the trigger functions to deactivate an internal safety mechanism in the archery release 10. It should be appreciated that alternative embodiments are possible.

In an alternative embodiment, the predetermined release threshold is set at or below the holding weight of the bow 6. In this embodiment, the act of pulling the trigger does cause the bow 6 to immediately fire the arrow. In this configuration, the archery release 10 functions similar to an index trigger release. The archery release 10 of the present disclosure allows the archer to elect how he or she prefers the archer rest function. The archer could choose to set up the archery release 10 to fire upon pulling the trigger or fire upon pulling the trigger plus additional tension (back tension).

The archery release 10 of the present disclosure provides desirable versatility in that it can be used effectively in various applications and can satisfy the shooting desires of a wider range of shooters. For example, for target shooting or longer range hunting, the archer may elect to set the device to fire upon pulling the trigger plus additional tension and in closer range faster moving targets, the archer may elect to set up the release 10 to shoot immediately upon pulling the trigger. In addition, over the archer's progression with archery his or her preferred method of releasing the arrow may change and the archery release 10 of the present disclosure can be set up to accommodate those evolutions. It should be appreciated that many other alternative configurations are possible. For example, in an alternative configuration, the release 10 could be built such that it can only fire upon trigger pull or only fire upon trigger pull plus additional tension.

In the depicted embodiment, the tension release assembly 28 includes a pivoting sear member 40. In the depicted embodiment, the pivoting sear member 40 includes a first end portion 44, a second end portion 46, and a mid-body portion 48. In the depicted embodiment, the first end portion 44 includes a pivot 50 that pivotally mounts the pivot sear member 40 to the housing 12. In the depicted embodiment, the pivot 50 is at the front end portion 14 of the housing 12 and at the adjacent second side 20. In the depicted embodiment, the pivoting sear member includes a boomerang geometry. In the depicted embodiment, the predetermined release threshold can be reliably and repeatably adjusted in non-discrete increments (e.g., 1 pound of force, ⅛ pound of force, etc.) and through a very large range. In the depicted embodiment, the configuration is very robust. Once the tension release assembly is set to a particular desired holding force, the release maintains the user setting accurately and precisely even after heavy use in the field. In the depicted embodiment, the first end portion 44 of the pivoting sear member 40 defines a first central axis and the second end portion 46 of the pivoting sear member 40 defines a second central axis. In the depicted embodiment, the intersection of the first and second central axis defines an angle AA between 110 to 160 degrees (e.g., 125-145 degrees). In the depicted embodiment, the second end portion 46 includes a trigger assembly engagement distal end. In the depicted embodiment, the mid-body portion 48 includes a sear 52 and an arcuate sliding surface 54. In the depicted embodiment, the arcuate sliding surface 54 is located between the sear 52 and the pivot 50. It should be appreciated that many alternative configurations are possible.

In the depicted embodiment, the tension release assembly 28 includes a sear spring assembly 56 located within the housing 12. In the depicted embodiment, the sear spring assembly 56 is configured to apply an adjustable force against the pivoting sear member 40. In the depicted embodiment, the adjustable force applied is directly correlated to the predetermined release threshold. In the depicted embodiment, the sear spring assembly 56 includes a coil spring 60. In the depicted embodiment, the coil spring 60 at a fixed lateral location relative to the housing. In the depicted embodiment, the intersection between the spring axis and the pivoting sear member 40 defines a force application point. In the depicted embodiment, the force application point is between 10 to 20 millimeters (e.g., 12-18 millimeters) from the sear 52. This relatively long distance and the geometry of the components in the depicted embodiment provides the coil spring 60 a relatively large lever arm and minimizes the amount of displacement of the sear that is required to release the rotary disk 32. The configuration of the depicted embodiment minimizes the forces needed to move the sear 52 (e.g., inherent frictional forces between the sear and the sear engagement surface) and maximizes the efficiency of the ability of the spring to generate the desired forces.

In the depicted embodiment, the coil spring 60 is positioned in a channel in the housing. In the depicted embodiment, the coil spring 60 includes a first end 62 and a second end 64. In the depicted embodiment, the coil spring 60 is located in the housing 12 such that the first end 62 contacts the pivoting sear member 40 and the second end 64 is biased against a bearing 66. In the depicted embodiment, a central axis of the coil spring 60 is generally perpendicular to the second end portion 46 of the pivoting sear member 40. In the depicted embodiment, the bearing 66 abuts a set screw 68 that is exposed on the second side surface 20 of the housing 12. In the depicted embodiment, since the set screw 68 is accessible on the outside of the housing 12 it is easily user adjustable. The archer can incrementally drive the set screw 68 further into the housing 12 thereby driving the bearing 66 further into the coil spring 60 thereby increasing the preload on the coil spring 60. In the depicted embodiment, the adjustment of the set screw increase the spring force on the pivoting sear member 40 with minimal effect on the amount of frictional forces acting between the sear 52 of the pivoting sear member 40 and the sear engagement surface 34 of the rotary disk 32. It should be appreciated that many alternative configurations are possible.

In the depicted embodiment, the predetermined release threshold of the release 10 is set by adjusting the preload on the coil spring 60. In the depicted embodiment, the predetermined release threshold is adjustable through a large range (e.g., between six to forty pounds of force, one to fifty pounds of force, one to forty pounds of force) without requiring the switching out of the coil spring 60. Because six pounds is generally less than the holding weight of many bows, the predetermined release threshold of the tension release assembly 28 of the depicted embodiment can be decreased such that activating the trigger assembly causes the bow string engagement assembly 26 to immediately release the bow string 8. Since forty pounds is greater than the holding weight of most bows, the predetermined release threshold of the tension release assembly 28 can be increased such that activating the trigger assembly does not itself cause the bow string engagement assembly 26 to release. One of the many desirable ways to set up the archery release 10 of the present disclosure is to set the predetermined release threshold several pounds greater than the holding weight of the particular bow 6 that the archer is shooting. It should be appreciated that many alternative configurations and methods of use are also possible.

In the depicted embodiment, the archery release 10 includes a trigger assembly 30 mounted to the housing 12 configured to selectively activate and deactivate the tension release assembly 28. In the depicted embodiment, the trigger assembly 30 includes a trigger member 70 that is pivotally mounted to the housing 12 via a pivot 80. In the depicted embodiment, the pivot 80 is adjacent and within to the second side 20 of the housing 12. In the depicted embodiment, the depressing the trigger pivots the trigger clockwise and release the trigger pivots the trigger counterclockwise. In the depicted embodiment, the trigger assembly 30 includes a trigger spring 72 (e.g., coil spring) that biases the trigger member 70 towards the front end portion 14 of the housing 12. It should be appreciated that many alternative configurations are possible.

In the depicted embodiment, the trigger member 70 is biased into engagement with a second end portion 46 of the pivoting sear member 40 by the trigger spring 72. In the depicted embodiment, the pivoting sear member 40 is constrained from pivoting through its full range of motion when engaged with the trigger member 70. It should be appreciated that many alternative configurations are possible.

In the depicted embodiment, the trigger member 70 includes a recess 74 that is sized to receive the second end portion 46 of the pivoting sear member 40. In the depicted embodiment, the recess 74 is adjacent to the first side 18 of the housing 12. In the depicted embodiment, the recess 74 includes a trigger sear contact surface 76 that contacts the pivoting sear member 40. In the depicted embodiment, the trigger member 70 includes a shot back off ramp 78 that is located adjacent the trigger sear contact surface 76. In the depicted embodiment, the trigger member 70 is configured to reset and lock the tension release assembly 28 if the archer lets up on the trigger just before the shot is fired. If the archer decides at the last moment not to take the shot, the trigger spring 72 biases the trigger forward and the second end portion 46 of the pivoting sear member 40 slides up the shot back off ramp 78 back into engagement with the trigger sear contact surface 76.

It should be appreciated that in some modes of operation the trigger acts as a safety. When the trigger is pulled, the safety is off and when the trigger is in its normal forward state, the safety is on (normally on safety). When the safety is on, the release 10 will not release the bow string 8 even if a tension force applied to the release 10 by the archer exceeds the predetermined release threshold. Conversely, when the trigger is depressed, the bow 6 will fire when a tension force applied to the release 10 by the archer exceeds the predetermined release threshold. The normally on safety is desirable as it minimizes misfires. Also, the act of depressing a trigger to prepare the bow 6 to fire or cause it to fire is intuitive as compared to depressing a trigger to engage the safety and letting off a trigger to prepare the bow 6 to fire. It should be appreciated that alternative configurations are possible. For example, alternatively, the safety could be normally off and depressing the trigger could engage the safety.

The present disclosure provides a new method for firing a bow. In an embodiment of the method, the method includes the step of setting a predetermined release threshold of the tension release assembly above a holding weight of the bow. The method includes the step of engaging a bow string engagement assembly with a bow string of the bow. The method includes the step of pulling against a wrist strap to draw the bow. The method includes the step of depressing the trigger of the trigger assembly. The method includes the step of applying additional tension to the release until the predetermined release threshold is met thereby firing the bow.

The description and illustration of one or more embodiments provided in this application are not intended to limit or restrict the scope of the invention as claimed in any way. The embodiments, examples, and details provided in this application are considered sufficient to convey possession and enable others to make and use the best mode of the claimed invention. The claimed invention should not be construed as being limited to any embodiment, example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the claimed invention and the general inventive concept embodied in this application that do not depart from the broader scope.

We claim:

1. An archery release comprising:

a housing including a front end portion, a rear end portion, a top, a bottom, a first side, and a second side;

a bow string engagement assembly mounted to the front end portion of the housing, wherein the bow string engagement assembly is configured to engage a bow string and generate a pulling force on the bow string in a first state and to release the bow string in a second state;

a tension release assembly provided within the housing configured to hold the bow string engagement assembly in the first state when the pulling force on the bow string is below a predetermined release threshold, wherein the tension release assembly is configured to transition the bow string engagement assembly to the second state when the pulling force on the bow string exceeds the predetermined release threshold; and a trigger assembly mounted to the housing configured to selectively activate and deactivate the tension release assembly, wherein the trigger assembly includes a trigger member including a first end pivotally mounted inside of the housing and a second end that extends outwardly from the first side of the housing, wherein the trigger member is biased in a first position and configured to be pulled rearwardly by an archer's finger to a second position, wherein the tension release assembly is deactivated when the trigger member is in the first position.

2. The archery release of claim 1, wherein the tension release assembly includes a pivoting sear member, the pivoting sear member includes a first end portion, a second end portion, and a mid-body portion, the first end portion including a pivot that pivotally mounts the pivoting sear member to the housing, the second end portion including a trigger assembly engagement distal end, and the mid-body portion including a sear and an arcuate sliding surface, the arcuate sliding surface being located between the sear and the pivot.

3. The archery release of claim 1, wherein the tension release assembly includes a pivoting sear member, the pivoting sear member including a first end portion, a second end portion, and a mid-body portion, the first end portion including a pivot that pivotally mount the pivoting sear member to the housing, a sear spring assembly located within the housing, the sear spring assembly configured to apply an adjustable force against a fixed longitudinal location along the second end portion of the pivoting sear member.

4. The archery release of claim 3, wherein the sear spring assembly includes a coil spring including a first end, a second end, and a central axis, wherein the central axis bisects the central axis of the second end portion of the pivoting sear member at an angle between 80 to 100 degrees.

5. The archery release of claim 3, wherein the sear spring assembly includes a coil spring including a first end and a second end, the coil spring being located in the housing such that the first end contacts the pivoting sear member and the second end is biased against a bearing, the bearing being driven by a set screw that is exposed to the second side surface of the housing, the set screw being user adjustable.

6. The archery release of claim 3, wherein the sear spring assembly includes a coil spring located between the second end of the pivoting sear member and a set screw, wherein the set screw is configured to compress the coil spring through a range of travel between zero millimeters to 10 millimeters.

7. The archery release of claim 2, wherein the first end portion of the pivoting sear member defines a first central axis and the second end portion of the pivoting sear member defines a second central axis, wherein the intersection of the first and second central axis defines an angle between 110 to 160 degrees.

8. The archery release of claim 2, wherein the bow string engagement assembly includes a rotary disk member, the rotary disk member includes an eccentric pivot that pivotally connects the rotary disk member to the housing, a bow string catch that engages the bow string, a sear engagement surface, and a sear reset foot, wherein the sear reset foot is configured to abut against the arcuate sliding surface of the pivoting sear member.

9. The archery release of claim 8, further comprising a wrist strap anchor located at the rear end portion of the housing, the wrist strap anchor being aligned with the bow string catch of the rotary disk member.

10. The archery release of claim 1, wherein the trigger assembly includes a trigger spring that biases the trigger member towards the front end portion of the housing.

11. The archery release of claim 10, wherein the trigger member is biased into engagement with a second end portion of a pivoting sear member by the trigger spring, wherein the pivoting sear member is constrained from pivoting through its full range of motion when engaged with the trigger member.

12. The archery release of claim 2, wherein the trigger member includes a recess that is sized to receive the second end portion of the pivoting sear member, wherein the recess includes a trigger sear contact surface.

13. The archery release of claim 12, wherein a shot back off ramp is located adjacent to the trigger sear contact surface.

14. The archery release of claim 1, wherein the predetermined release threshold of the tension release assembly can be decreased such that activating the trigger assembly causes the bow string engagement assembly to release the bow string.

15. The archery release of claim 1, wherein the predetermined release threshold of the tension release assembly can be increased such that activating the trigger assembly does not itself cause the bow string engagement assembly to release.

16. The archery release of claim 1, wherein the predetermined release threshold is adjustable between six to forty pounds of force without the need to exchange the any internal components.

17. An archery release comprising:

a housing including a front end portion and a rear end portion;

a bow string engagement assembly including a jaw member, the jaw member pivotally connected to the front end portion of the housing, the jaw member configured to engage a bow string, the jaw member being pivotable from a closed position to an open position, wherein in the closed position the jaw member is configured to catch the bow string and generate a pulling force on the bow string when the housing is pulled relative to the bow string and wherein in the open position the jaw member releases the bow string;

a tension release assembly within the housing configured to hold the jaw member in the closed position when the pulling force on the bow string is below a predetermined release threshold, wherein the tension release assembly is configured to allow the jaw member to pivot to the open position when the pulling force on the bow string acting exceeds the predetermined release threshold; and a trigger assembly including a trigger including a first end pivotally mounted to the housing and a second end that extends outwardly from the housing, the trigger configured to pivot from a normally extended position to a retracted position, wherein when the trigger is in the extended position the tension release assembly is deactivated such that the jaw member is locked in the closed position even if the pulling force on the bow string exceeds a predetermined release threshold, wherein when the trigger is in the retracted position the tension release assembly is activated such that the jaw member pivots to the open position when the pulling force on the bow string exceeds the predetermined release threshold.

18. The archery release of claim 17, wherein the housing includes a wrist strap anchor located at the rear end portion of the housing.

19. The archery release of claim 18, further comprising a wrist strap connected to the wrist strap anchor.

20. The archery release of claim 17, wherein the housing is configured to exclusively contact a shooter's index finger and is devoid of structure that contacts the shooter's thumb or other fingers.

21. A method of drawing and firing a bow using the archery release of claim 1, the method comprising:

setting the predetermined release threshold of the tension release assembly above a holding weight of the bow;

pulling against a wrist strap to draw the bow;

depressing the trigger member of the trigger assembly thereby causing the trigger member to pivot in a direction away from a main body portion of the release; and applying additional tension to the release until the predetermined release threshold is met thereby firing the bow.

* * * * *